US006808132B2

(12) United States Patent
Scheibe et al.

(10) Patent No.: US 6,808,132 B2
(45) Date of Patent: Oct. 26, 2004

(54) INJECTION VALVE FOR INJECTING FUEL INTO THE COMBUSTION CHAMBER OF AN INTERNAL COMBUSTION ENGINE

(75) Inventors: Wolfgang Scheibe, Ludwigsburg-Poppenweiler (DE); Horst Ressel, Winnenden (DE)

(73) Assignee: L'Orange GmbH, Stuttgart (DE)

( * ) Notice: Subject to any disclaimer, the term of this patent is extended or adjusted under 35 U.S.C. 154(b) by 0 days.

(21) Appl. No.: 10/296,621

(22) PCT Filed: May 25, 2001

(86) PCT No.: PCT/EP01/05973

§ 371 (c)(1),
(2), (4) Date: Jul. 15, 2003

(87) PCT Pub. No.: WO01/90566

PCT Pub. Date: Nov. 29, 2001

(65) Prior Publication Data

US 2004/0074983 A1 Apr. 22, 2004

(30) Foreign Application Priority Data

May 26, 2000 (DE) ..... 100 26 286

(51) Int. Cl.[7] ..... F02M 61/10

(52) U.S. Cl. ..... 239/533.11; 239/96; 239/533.3; 239/533.9; 239/584; 123/294; 123/447

(58) Field of Search ..... 239/88, 96, 533.3, 239/533.9, 533.11, 585, 585.1; 123/294, 305, 447, 456, 458

(56) References Cited

U.S. PATENT DOCUMENTS

| | | | | |
|---|---|---|---|---|
| 4,398,670 A | * | 8/1983 | Hofmann | 239/533.9 |
| 4,516,730 A | | 5/1985 | Fuessner | |
| 4,566,416 A | | 1/1986 | Berchtold | |
| 4,674,688 A | | 6/1987 | Kanesaka | |
| 4,784,102 A | | 11/1988 | Igashira et al. | |
| 4,957,085 A | * | 9/1990 | Sverdlin | 239/533.9 |
| 5,641,121 A | | 6/1997 | Beck et al. | |
| 5,832,899 A | | 11/1998 | Soteriou | |
| 5,979,803 A | | 11/1999 | Peters et al. | |
| 6,189,817 B1 | * | 2/2001 | Lambert | 239/533.11 |
| 6,405,941 B2 | * | 6/2002 | Ganser | 239/533.11 |

FOREIGN PATENT DOCUMENTS

| | | |
|---|---|---|
| DE | 19837890 A1 | 2/2000 |
| EP | 0331198 A2 | 9/1989 |
| EP | 0333097 A2 | 9/1989 |
| EP | 0427271 A1 | 5/1991 |
| WO | WO 01/27463 A1 | 4/2001 |

* cited by examiner

*Primary Examiner*—Steven J. Ganey
(74) *Attorney, Agent, or Firm*—Crowell & Moring LLP

(57) ABSTRACT

An injection valve for injecting fuel into the combustion chamber of an internal combustion engine has an injector needle guided inside the housing in such a way that it can be displaced longitudinally with a shaft in order to open and close the injection cross-sections. The injector needle is actuated by the fuel pressure which act upon the injector needle and by a closing spring acting in the closing direction of the injection needle. The closing spring is pre-compressed between abutments on the injector needle and the housing and is situated on the perimeter of the injector needle in the area between the injector needle guide and the valve seat. One advantage of the arrangement is the compact construction of the injection valve and the low dead volume of the control chamber on the reverse side of the injector needle.

5 Claims, 1 Drawing Sheet

INJECTION VALVE FOR INJECTING FUEL INTO THE COMBUSTION CHAMBER OF AN INTERNAL COMBUSTION ENGINE

BACKGROUND AND SUMMARY OF THE INVENTION

This invention concerns an injection valve for injecting fuel into the combustion chamber of an internal combustion engine.

Such an injection valve is assumed to be known, for example, from U.S. Pat. No. 5,832,899. The housing of the injection valve consists of a nozzle part with an injection opening and a nozzle holder, on which the nozzle part is attached with a threaded bush. A longitudinally movable guided nozzle needle is accommodated in a bore of the nozzle part. Clamped between the nozzle holder and the nozzle part is an insert, which delimits on one side a control chamber in which the nozzle needle is located with its rear end facing away from the injection holes. On the opposite side, the insert has a discharge outlet, which is connected to the control chamber via a central bore and a discharge throttle. The control chamber is connected via an intake throttle to a fuel channel, which conducts fuel under pressure toward a nozzle chamber located ahead of the injection holes. The fuel pressure acting on the back of the nozzle needle when the discharge opening is closed holds the nozzle needle with a valve closing spring on a valve seat in the nozzle part, so that no injection occurs. If the discharge opening controlled by the control valve is released, the fuel pressure in the control chamber drops, and the nozzle needle lifts from its valve seat due to the fuel under injection pressure acting on the front of the nozzle needle. A disadvantage of the illustrated injection valve is that a large dead volume is formed by the closing spring located in the control chamber, which acts on the back of the nozzle needle. The reaction of the injector to the switching signals, however, is dependent upon the size of the dead volume of the control chamber. If, for example, an injection is to be initiated, then the dead volume must first be released, for which a time period is necessary, which increases the reaction time of the injection start with respect to the control signal. Inversely, the dead volume also causes an extension of the reaction time when the injection valve is closed to conclude the injection. Long reaction times affect the accuracy of the injection and worsen the suitability of the injector for the pilot injection.

It is an object of the invention to specify a closing spring arrangement with a simple construction which, on the one hand, allows a compact design of the injection valve and, on the other hand, makes possible short reaction times to switching signals.

This object of the invention is attained in that the closing spring is provided on the periphery of the nozzle needle below the nozzle needle guide outside of the control chamber.

This arrangement of the closing spring allows a compact design of the injection valve without having to tolerate a complicated construction. In a preferred embodiment, the face of a guide sleeve serves as abutment for the closing spring on the side of the housing. The nozzle needle is advantageously configured with a surrounding groove, in which an inwardly resilient pre-tensioned ring is locked, on which the spring plate of the closing spring can be supported.

An exemplary embodiment of the invention is explained with reference to the drawings.

DETAILED DESCRIPTION OF THE INVENTION

Figure 1:
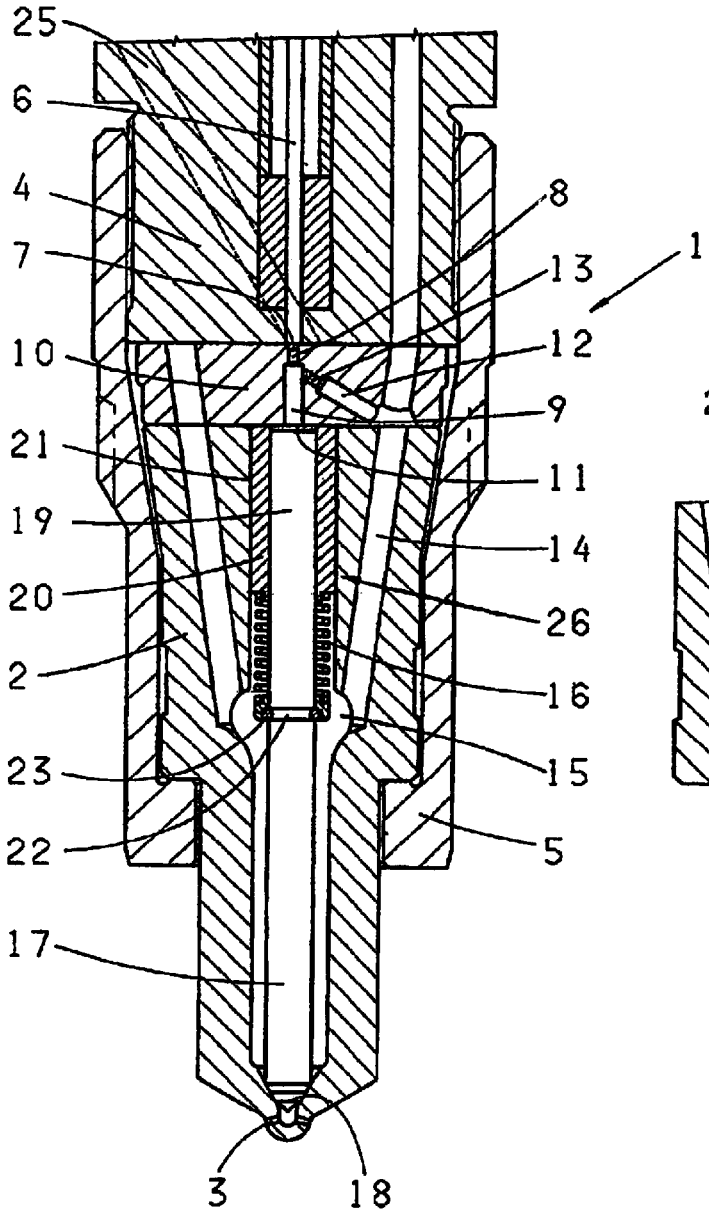
FIG. 1 shows a longitudinal section through the injection valve in accordance with the invention in the area of the nozzle part.

FIG. 1 shows a longitudinal section of an injection valve 1 in the area of the nozzle part 2. The nozzle part 2, which contains the injection holes 3, is attached with the aid of a threaded bush 5 on the nozzle holder 4, which is not shown in its entirety. A nozzle needle 17 is guided in an axial motion into the nozzle part 2. The nozzle needle 17 is placed with a nozzle needle shaft 19 in a guide sleeve 20, which forms a guide 26, which in turn is arranged in a housing bore 21 of the nozzle part 2. The nozzle holder 4 contains an electromagnetic control valve, which is not shown and whose anchor is connected to a control element 6. The control element 6, which is also shown only partially, can be designed in the form of a rod, whose face, as shown, co-acts with a discharge opening 7. The discharge opening 7 is connected to a control chamber 11 via a closing throttle 8 and a bore 9 in an insert 10 between the nozzle holder 4 and the nozzle part 2. The control chamber 11 is connected via another bore 12 and an intake throttle 13 to a fuel intake channel 14, via which the fuel, which is under the injection pressure, is fed to a nozzle antechamber 15, which is accommodated ahead of the injection holes 3. The nozzle needle 17 is held against the valve seat 18 in the nozzle part 2 due to the fuel pressure existing when the drainage opening 7 in the control chamber 11 is closed, and therefore due to the fuel pressure acting on the back of the nozzle needle and also the pre-tensioned closing spring 16 acting in the closing direction, so that no injection takes place. If the control element 6 is pulled back and the discharge opening 7 is released, the pressure in the control chamber 11 drops. The fuel flowing through the discharge opening 7 reaches the return flow channel 25 shown with dashed lines. The speed with which the pressure drop for opening and the pressure increase for closing the injection valve takes place in the control chamber 11 should be as high as possible to facilitate a fast reaction of the injection valve 1 to the switching signals. This assumption is provided in that the control chamber 11 remains free of built-in components and therefore has a small dead volume, which is made possible by the arrangement of the closing spring 16 on the nozzle needle periphery. At the same time, the arrangement of the closing spring 16 on the periphery of the nozzle needle 17 allows a simple construction of the injection valve 1, so that a particularly compact design is possible.

Figure 2:
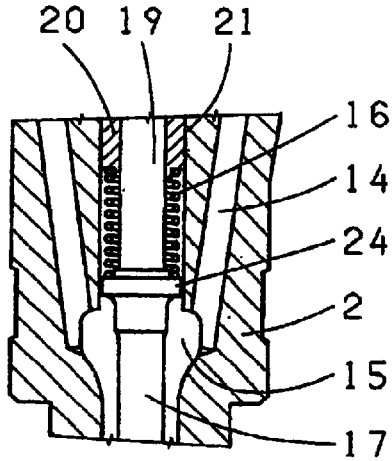
FIG. 2 shows a nozzle needle with a molded edge as abutment.

The abutments required for supporting the closing spring 16 are formed by the guide 20 of the nozzle needle shaft 19 on the side of the housing in accordance with FIG. 1. In this way, the closing spring 16 is supported on a face of the guide sleeve 20. The abutment can be formed on the side of the nozzle needle, for example, by a peripheral groove 22 and a radially inwardly resilient spring 23 locked therein. As shown in FIG. 2, it is also possible to configure the abutment on the nozzle needle 17 via an edge 24 formed as one piece with the nozzle needle 17.

What is claimed is:

1. An injection valve for injecting fuel into a combustion chamber of an internal combustion engine, comprising:

a housing and a valve needle, a valve needle shaft via which the valve needle is mounted in a longitudinally movable manner in a guide in the housing, a valve seat in conjunction with which the valve needle operates at one end for the purposes of opening and closing an injection cross section of the housing, the injection valve having a nozzle vestibule that is mounted in front of the valve needle shaft on a valve side, the nozzle vestibule being connected to a fuel supply channel for supplying the fuel which is to be injected and which is under pressure, the injection valve having a regulating chamber that is connected to the valve needle, and the regulating chamber being capable of being impacted with fuel that is under pressure, an adjusting component capable of relieving the pressure in the regulating chamber, the adjusting component being connected to a regulating valve for opening the valve needle, the injection valve having a closing spring that impacts the valve needle in the closing direction, abutments on the valve needle and housing in conjunction with which the closing spring operates, the closing spring being arranged on a periphery of the valve needle in the region between the valve needle shaft and the valve seat, the housing of the injection valve being constructed with a separate nozzle component that is secured on a nozzle holder, the valve needle lying in the regulating chamber via its rearward end that faces away from the valve seat, the regulating valve being arranged in the nozzle holder above the regulating chamber, the adjusting component regulating an outlet opening that is connected to the regulating chamber, a disk-shaped insert component provided between the nozzle component and the nozzle holder, the insert component containing the outlet opening and serving as an arrestment buffer for the valve needle, and a guide sleeve in which the valve needle shaft is guided, a front edge of the guide sleeve serving, on a housing side, as an abutment for the closing spring, the front edge facing away from the regulating chamber, wherein the nozzle component reaches as far as the insert component, the nozzle component contains the fuel supply channel, and, over its entire length, the guide sleeve lies inside the nozzle component.

2. The injection valve in accordance with claim 1, wherein a circumferential edge, which is connected to the valve needle, serves as an abutment on the valve needle side.

3. The injection valve in accordance with claim 2, wherein the edge forms one single entity together with the valve needle.

4. The injection valve in accordance with claim 3, wherein the edge is formed from a ring that is secured on the valve needle.

5. The injection valve in accordance with claim 4, wherein the ring lies in a groove of the valve needle and is under radial pre-tension.

* * * * *